United States Patent [19]

Matsushita

[11] 4,373,881

[45] Feb. 15, 1983

[54] WORM-TYPE ROTARY FLUID COMPRESSOR

[75] Inventor: Yoshio Matsushita, Kawasaki, Japan

[73] Assignee: Iwata Air Compressor Manufacturing Company Ltd., Tokyo, Japan

[21] Appl. No.: 166,073

[22] Filed: Jul. 7, 1980

[30] Foreign Application Priority Data

Jul. 9, 1979 [JP] Japan ..... 54-85858

[51] Int. Cl.[3] ..... F04C 18/12; F04C 23/00

[52] U.S. Cl. ..... 418/195; 418/196

[58] Field of Search ..... 418/194, 195, 196

[56] References Cited

U.S. PATENT DOCUMENTS

Re. 30,400 9/1980 Zimmern ..... 418/195

711,083 10/1902 Taylor ..... 418/195

2,327,089 8/1943 Bejeuhr ..... 418/195

FOREIGN PATENT DOCUMENTS 2833292 2/1979 Fed. Rep. of Germany ..... 418/195

*Primary Examiner*—John J. Vrablik

*Attorney, Agent, or Firm*—Thomas R. Morrison

[57] ABSTRACT

This invention relates to worm-type rotary fluid means, wherein a worm body having a plurality of helical screw threads and a plurality of grooves therebetween is engaged with a cylindrical pinion having a plurality of teeth. In this engagement, the fluid discharge volume is increased much greater than that of a conventional worm. This is due to the fact that the engagement of each pinion tooth of each worm groove has increased contact length and depth. Further, this causes a very stable engagement.

4 Claims, 9 Drawing Figures

Priort Art

WORM-TYPE ROTARY FLUID COMPRESSOR

BACKGROUND OF THE INVENTION

1. Field of the Invention

This invention relates to a worm-type rotary means, and particularly improvements in or relating to a worm body which is engaged with a cylindrical pinion. The worm-type rotary means of this invention is applicable for compressors, vacuum pumps, fluid expansion devices and other various rotary fluid means.

2. Description of the Prior Art

With reference to FIGS. 1 and 4, the defects and problems of the conventional art will now be described hereinafter.

The techniques of the conventional art are disclosed, for example, in the French Patent Application No. 139,172, Japanese Examined Patent Publication No. 48-12203, etc.

FIG. 1 shows a mutual engagement of a cylindrical worm of a conventional compressor with a cylindrical pinion. FIG. 2 shows a view of its mutual engagement.

In FIGS. 1 and 2, teeth 2*a*, 2*b*, 2*c* and 2*d* of a cylindrical pinion 2 are engaged with grooves 1*a*, 1*b*, 1*c* and 1*d* of a worm of a cylindrical shape in an outer profile. When the worm 1 is rotated in an arrow direction 3, the pinion 2 is rotated in an arrow direction 4 or clockwisely. The grooves 1*a*, 1*b*, 1*c*, 1*d* are covered by a casing (not illustrated) which is mounted on each top of the worm helical threads. The worm groove 1*a* is not closed by the pinion tooth 2*a*, while the groove 1*b* is just closed by the pinion tooth 2*b*. Then, a certain volume of fluid is sealed in the groove 1*b* which is covered by two opposite flanks of the worm screw threads as well as by the casing. It is a whole fluid discharge volume. As the worm 1 is rotated, a certain air or gas volume introduced in the groove 1*b* is gradually compressed and discharged finally out of a discharge port (not illustrated) of the casing. The compressing process of the fluid is changed to the grooves 1*c* and 1*d*. In FIG. 1, a fluid suction area is denoted at X.

FIG. 3 is a cubic view of a whole fluid discharge volume within a groove of the worm 1. The whole fluid discharge volume is illustrated with a cubic volume having a starting surface (points A, B, C, D) and a peak E communicated to a discharge port.

Symbols I, II, III, IV show respective partitioned areas in the fluid compressing process. Symbols A, G, H, I, E show respective points contacting the pinion tooth side with the worm groove side wherein the pinion tooth is detached from the worm groove at the point E communicated to the discharge port.

In this example, three teeth of the pinion 2 are always engaged with three grooves of the worm 1. The total length of the engagement of three pinion teeth with the three worm grooves is about 1.5 times as long as that of the engagement of a pinion tooth with a worm groove as shown in I of FIG. 3, that is distance AC+Distance FD.

As seen in FIG. 3, a cubic volume of the fluid suctioned at symbol I is reduced gradually toward the point E. The whole fluid discharge volume in the conventional worm is much less than that in the worm-type rotary fluid means according to this invention. In the conventional worm, the contact of the pinion tooth side with the worm groove is not overall but partial. For example, a point K in the pinion tooth side is ended at point K'.

FIG. 4 is another example of a conventional compressor in which a disc-type worm 11 is engaged with a cylindrical pinion 12. This example has also the same defects and problems as the example of FIG. 1. In both examples the engagement of the pinion tooth with the worm groove shortens their contact length and depth. Further, since the depth of the worm groove is short and the height of the worm screw thread is low, the pinion tooth is partially engaged with the worm groove. Accordingly, the above engagement is not uniform and the effect of fluid compression is insufficient.

BRIEF SUMMARY OF THE INVENTION

According to this invention, a worm-type rotary fluid means comprises a worm body, a cylindrical pinion engaged with the body, a casing mounted on the worm body to seal the fluid, a fluid suction opening and a fluid discharge opening, said worm body having a plurality of spiral screw threads and a plurality of grooves spaced equally therebetween, a flank of the spiral screw thread being formed with an equal height along a bottom of the groove and being lowered gradually at a position near to the fluid discharge opening, and the casing being bent at the position near to the fluid discharge opening.

It is an object of this invention to provide a worm-type rotary fluid means wherein a fluid discharge volume is increased much greater than that of a conventional means by improving the worm body engaged with the cylindrical pinion.

It is another object of this invention to provide a worm-type rotary fluid means wherein the engagement of each pinion tooth with each worm groove increases its contact length and depth greatly, thereby the worm body is engaged stably with the cylindrical pinion.

Other and further objects, features and advantages of this invention will become apparent from the following description with reference to the accompanying drawings.

BRIEF DESCRIPTION OF THE ACCOMPANYING DRAWINGS

DETAILED DESCRIPTION OF THE INVENTION

A preferred example of this invention will now be described with reference to the accompanying drawings 5 to 9. The casing has been omitted from FIGS. 5–8 for clarity of presentation but is shown in FIG. 9.

Figure 1:
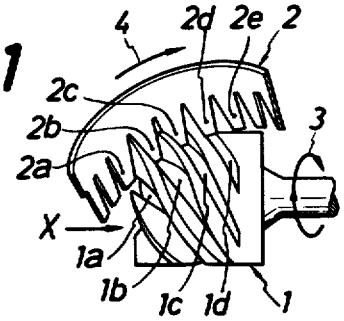
FIG. 1 is a perspective view of a conventional rotary compressor wherein a cylindrical worm is engaged with a cylindrical pinion.
Figure 2:
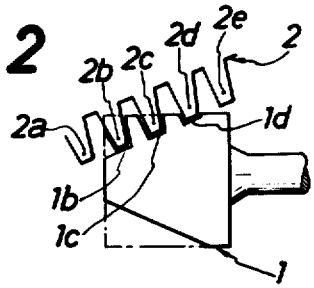
Prior Art Fig. 2
FIG. 2 is a view showing the engagement of the worm with the pinion in the rotary compressor of FIG. 1.
Figure 3:
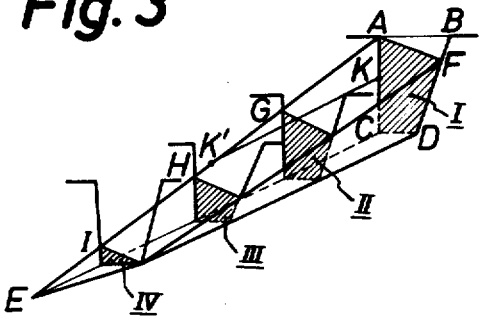
Prior Art Fig. 3
FIG. 3 is a cubic view of a whole fluid discharge volume within a groove of the worm in FIG. 1 and shows its compressing process.
Figure 4:
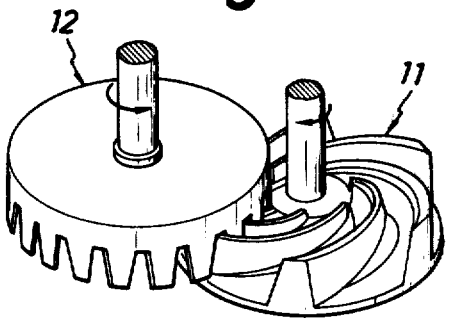
FIG. 4 is a perspective view of a conventional rotary compressor wherein a disc-type worm is engaged with a cylindrical pinion.
Figure 5:
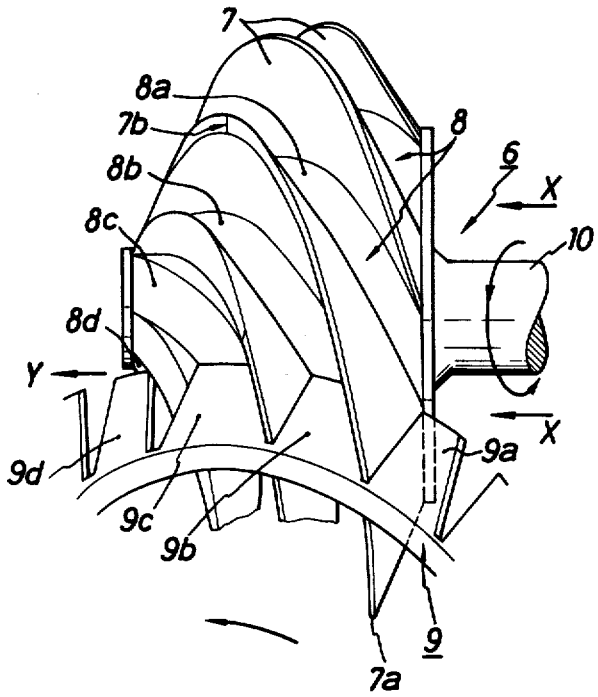
Prior Art Fig. 5
FIG. 5 is a perspective view of a worm-type rotary fluid means according to this invention, wherein a worm body is engaged with a cylindrical pinion.

Numeral 6 is a worm body according to this invention. In this example, the worm 6 comprises six spiral screw threads 7 and six grooves 8 spaced equally therebetween. Each groove is formed from a fluid suction area X to a fluid discharge area Y while having a curve. Numeral 9 is a cylindrical pinion engaged with the worm 6, and it has a plurality of teeth. As shown in FIG. 5, three teeth of the pinion 9 are always engaged with three grooves of the worm 6. As a shaft 10 of the worm 6 is rotated in an arrow direction, the pinion 9 is rotated in an arrow direction. In FIG. 5, the pinion teeth 9*a*, 9*b*, 9*c* and 9*d* are engaged with the worm grooves 8*a*, 8*b*, 8*c* and 8*d* respectively.

The worm body 6 is covered by a casing (not illustrated but similar to 13 in FIG. 9) in order to seal the fluid in each worm groove 8, the casing being mounted with a slight gap on the top of each spiral screw thread 7. Thus, the groove 8 is sealed by the pinion 9 tooth, two adjacent spiral screw threads 7 and the casing. A certain fluid volume suctioned from the fluid suction opening X is introduced into the groove 8 and compressed gradually as the worm 6 is rotated.

Compared with a conventional worm, the worm body of this invention has the following features.

The height of the spiral screw thread 7 is high and a flank thereof is formed with an equal height along a bottom of the groove 8. In other words, a space of each groove 8 is long and deep. The height of the spiral screw thread 7 declines gradually from a position 7*b* near the fluid discharge opening Y.

Therefore, the fluid volume introduced into the groove 8 is much greater than that of the conventional worm. In other words, the fluid discharge volume becomes greater.

Figure 6:
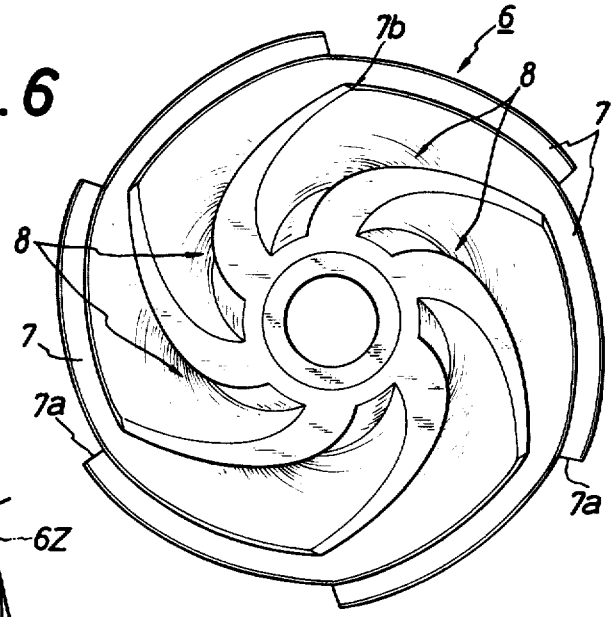
FIG. 6 is a plan view of the worm body in FIG. 5.
Figure 7:
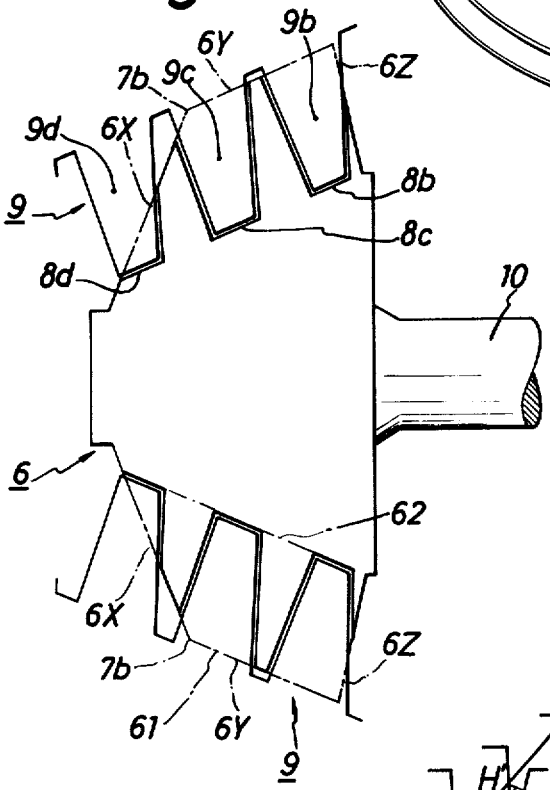
FIG. 7 is a side view showing a profile of the worm body in FIG. 5.

FIGS. 6 and 7 are illustrated in order to show the profile of the worm body 6. As shown in FIG. 6, the worm body 6 has a symmetrical shape, in which each of the spiral screw threads has the same shape and each of the grooves has the same shape. Preferably, an end 7*a* of the spiral screw thread 7 is started from a middle point of the adjacent spiral screw thread.

FIG. 7 shows an outer profile of a side view of the worm 6. It comprises a first conical portion 6X, a second conical portion 6Y and a third conical portion 6Z. The casing (not illustrated but similar to casing 13 of FIG. 9) is mounted with a slight gap on the first and second conical portions 6X and 6Y and bent at an end 7*b* of the spiral screw thread 7. The third conical portion 6Z is communicated to the fluid suction opening X, while the first conical portion 6X is communicated to the fluid discharge opening Y. As shown in FIG. 7, an outer profile 61 (imaginary line) of the second conical portion 6Y is spaced in parallel with a groove bottom line 62 crossing the grooves 8.

Figure 8:
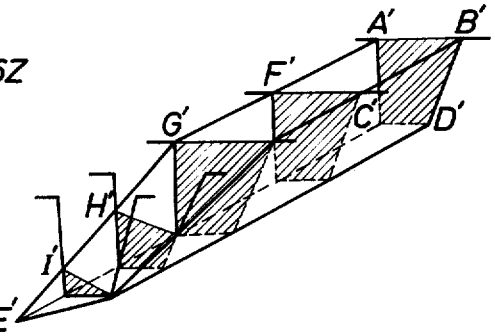
FIG. 8 is a cubic view of a whole fluid discharge volume within a groove of the worm body in FIG. 5.
Figure 9:
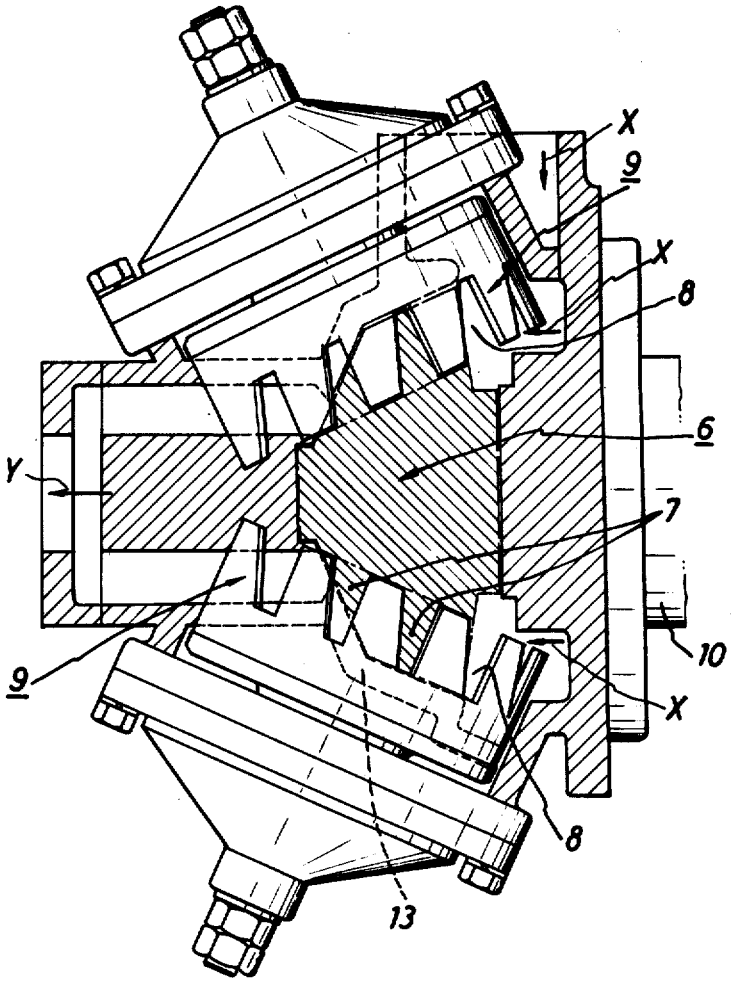
FIG. 9 is a partially cutaway section view of the means of FIG. 5 wherein the worm body is engaged with two cylindrical pinions.

FIG. 8 shows a cubic view of a whole fluid discharge volume introduced into each groove and a compressing process thereof. The whole fluid discharge volume has a starting surface (points A', B', C' and D') and an end point E' communicated to the fluid discharge opening Y. As seen from FIG. 8, the whole fluid discharge volume in this invention is much greater than that in the conventional art.

As shown in FIG. 5, when the pinion tooth closes the groove 8, its root complies with the groove depth. This fitting condition is maintained as far as two side edges of the pinion tooth slide with two flanks of the opposite spiral screw threads. When one side edge of the pinion tooth passes over the end 7*b* of the spiral screw thread, the fluid volume is compressed remarkably and discharged finally to the discharge opening Y.

In FIG. 8, symbols A', F', G', H' and I' show respective partitioned positions of the fluid volume sealed by the pinion tooth.

As described above, the fluid discharge volume within one groove in the worm of this invention is much more than that within one groove in the conventional worm. In case a pinion of the same diameter Dp(mm) is used to the conventional worm and the worm of this invention, the fluid discharge volume in the former is $10.8(Dp/100)^3$[cc], while that in the latter is $23.25(Dp/100)^3$[cc].

Namely, the fluid discharge volume in this invention is twice as much as that in the conventional worm. This means that when the rotational frequency of the worm according to this invention and of the conventional worm is the same, the fluid discharge volume of the former becomes twice more than that of the latter.

Further, the length of the engagement of the pinion tooth with the worm screw thread 8 is 2.5 times as long as that of the engagement of the conventional pinion tooth with the conventional worm screw thread. Accordingly, the condition of the above engagement according to this invention is stabilized much more than that of the conventional art.

Further, it is advantageous to employ the means according to this invention in engagement of the worm with two cylindrical pinions. This brings about a high efficiency in fluid compression. FIG. 9 shows its example. In FIG. 9, there is shown a casing 13 with a broken line, the casing 13 being bent between the first and second conical portions of the worm body.

Still further, the means according to this invention is applicable for compressors, vacuum pumps, fluid expansion devices and other various rotary fluid means.

What is claimed is:

1. A rotary fluid compressor of the type having a worm sealingly interengaging pinion teeth of at least one pinion, comprising:

said worm including a plurality of spiral teeth, said spiral teeth having an outer profile;

adjacent pairs of said spiral teeth defining a groove therebetween, said groove having a bottom groove line;

a cross section of said bottom groove line having a uniform taper from a fluid suction end to a fluid discharge end of said worm;

a cross section of said spiral teeth including a first tapered portion beginning at said suction end and a second tapered portion contiguous to said first tapered portion and ending at said discharge end;

said first tapered portion having an outer profile substantially parallel to said uniform taper whereby a portion of said spiral teeth bounded by said bottom groove line and said first tapered portion have a uniform height;

said second tapered portion being more sharply tapered than said uniform taper whereby a height of said teeth decreases toward said discharge end; and a casing generally conforming to said first and second tapered portions for sealing said fluid in at least a portion of said grooves.

2. A rotary fluid compressor according to claim 1, wherein said at least one pinion includes at least first and second opposed pinions interengaging said worm.

3. A rotary fluid compressor according to claim 1, wherein said worm interengages said pinion at three teeth thereof.

4. A rotary fluid compressor according to claim 1, wherein said first tapered portion engages at least two adjacent ones of said pinion teeth and said second tapered portion engages at least one of said pinion teeth.

* * * * *